United States Patent [19]

Hughes

[11] Patent Number: 4,676,495

[45] Date of Patent: Jun. 30, 1987

[54] ASSEMBLING SHEETS INTO A STACK

[75] Inventor: Robert W. Hughes, Hampshire, England

[73] Assignee: De La Rue Systems Limited, England

[21] Appl. No.: 836,966

[22] Filed: Mar. 6, 1986

[30] Foreign Application Priority Data

Mar. 6, 1985 [GB] United Kingdom ..... 8505759

[51] Int. Cl.[4] ..... B65H 39/02

[52] U.S. Cl. ..... 270/58; 271/198; 271/305

[58] Field of Search ..... 270/58, 60; 400/605, 400/607, 608.4; 271/198, 199, 305

[56] References Cited

U.S. PATENT DOCUMENTS

| | | | |
|---|---|---|---|
| 2,333,184 | 12/1950 | Trump | 271/198 |
| 2,563,498 | 8/1951 | Skinner | 271/198 X |
| 3,469,836 | 9/1969 | Javid | 271/199 X |
| 3,979,112 | 9/1976 | Munn et al. | 270/58 |
| 4,355,795 | 10/1982 | Bergland | 270/58 |
| 4,623,140 | 11/1986 | Allio et al. | 271/305 |

*Primary Examiner*—E. H. Eickholt

*Attorney, Agent, or Firm*—Ostrolenk, Faber, Gerb & Soffen

[57] ABSTRACT

Apparatus for assembling sheets into a stack, the apparatus comprising a stacking station having two laterally spaced guide elements (25A,25B) defining first and second guide surfaces fixed relatively to one another. First and second transport systems. (2,3; 9,11,12) define respective first and second paths, the first transport system being adapted to transport sheets along the first path to the stacking station (24) and the second transport system being adapted to transport sheets in both directions along the second path between positions upstream and downstream of the stacking station (24). The guide elements (25A,25B) are movable between first and second positions (25',25). In the first position sheets fed along the first and second paths from positions upstream of the stacking station (24) are guided along respective ones of the first and second guide surfaces to a position downstream of the stacking station in the second path. In the second position the guide elements (25A,25B) enable sheets in the second path to be moved between positions upstream and downstream of the stacking station (24) along the second path guided by the second surface and prevent sheets from passing into the first path. A microprocessor (31) controls operation of the first and second transport systems and the position of the guide elements (25A,25B) such that when the guide elements are in the first position, the speeds of the first and second transport systems are controlled whereby sheets fed along the first and second paths from upstream of the stacking station (24) are assembled together in a stack in the second path downstream of the stacking station.

10 Claims, 4 Drawing Figures

ASSEMBLING SHEETS INTO A STACK

FIELD OF THE INVENTION

The invention relates to apparatus for assembling sheets into a stack. The invention is particularly applicable to the assembly of banknotes and other security documents.

DESCRIPTION OF THE PRIOR ART

Processing banknotes and other documents one at a time in such a way as to form a neat stack at a stacking station within a feed system has always been a difficult task to do reliably. Current designs incorporate technologies such as stacking wheels and stacking under gravity which work only sufficiently in the limits of good note quality (stiffness, flatness and condition). Although these methods are generally satisfactory for notes of good quality they do not produce satisfactory stacks for bad quality notes primarily for the reason that during the stacking action the note is released for a short time.

SUMMARY OF THE INVENTION

In accordance with the present invention, apparatus for assembling sheets into a stack comprises a stacking station having guide means defining first and second guide surfaces fixed relatively to one another; first and second transport system defining respective first and second paths, the first transport system being adapted to transport sheets along the first path to the stacking station and the second transport system being adapted to transport sheets in both directions along the second path between positions upstream and downstream of the stacking station, wherein the guide means is movable between first and second postions whereby in the first position sheets fed along the first and second paths from positions upstream of the stacking station are guided along respective ones of the first and second guide surfaces past the guide means to a position downstream of the stacking station in the second path, and in the second position the guide means enables sheets in the second path to be moved between positions upstream and downstream of the stacking station along the second path guided by the second surface and prevents sheets from passing into the first path; and control means for controlling operation of the first and second transport systems and the position of the guide means whereby when the guide means is in the first position, the speeds of the first and second transport systems are controlled such that sheets fed along the first and second paths from upstream of the stacking station are assembled together in a stack in the second path downstream of the stacking station.

The invention avoids the use of stacking wheels and maintains control of the sheets at all times. This means that sheets to be stacked are never released before or during the stacking operation, an assembled stack is never released, and the assembled stack may be transported to any position within the overall feed system.

Furthermore the invention provides a very simple stacking station with the guide means having guide surfaces fixed relatively to one another. This means that a single movement of the guide means causes movement of both guide surfaces automatically and simultaneously thus reducing the risk of jamming of sheets.

In general there will be no sheets in the second path initially and a single sheet is fed along the first path to the stacking station. At the stacking station, this sheet is fed into the second path and is then reversed past the stacking station to the (escrow) position upstream of the stacking station. At this stage, the "stack" is constituted by the single sheet. A second sheet is then fed along the first path and the first sheet is fed back to the stacking station such that at the stacking station, the two sheets will be fed together at substantially the same rate along the second path and are thus assembled together. These assembled sheets are then fed back past the stacking station to the escrow position and the steps may be repeated as often as necessary to form a complete stack. Once a stack has been fully assembled, it may be moved along the second path to a stack removal position. This removal position may be upstream or downstream of the stacking position. One of the advantages of the invention is that the fully assembled stack may be moved in either direction along the second path as required.

The stack removal position may constitute simply a transfer position where the assembled stack is transferred to another transport system or a storage body such as a cassette or an output station at which the stack may be withdrawn by a user.

In general, a single stack of sheets will be assembled at a time. However, an increase in the speed of assembling sheets may be achieved by assembling sheets fed along the first path into a plurality of stacks in the second path. These stacks could then be assembled together by feeding them along a first path of further assembling apparatus.

Although sheets will normally be fed singly along the first path, it is possible for subsidiary stacks of two or more sheets to be fed along the first path for subsequent assembly into a main stack. on.

Preferably, the guide means is biased towards the second position and is movable to the first position under control of the control means. This enables an assembled stack of sheets to be moved freely to and fro past the stacking station without the necessity of actuating the control means to hold the guide means in its first position.

The control means may include a solenoid coupled with the guide means and operable to move the guide means at least to the first position. This provides a very convenient method for controlling the position of the guide means simply by suitably energising the solenoid.

The guide means may be non-rotatably mounted to a pivotally mounted shaft coupled with the control means, whereby rotation of the shaft causes the guide means to move between the first and second positions. This enables the position of the guide means to be controlled from a position remote from the stacking station by acting on the shaft. For example, in the case where a solenoid is used, a plunger of the solenoid may be coupled to a radially extending arm mounted to the shaft.

Conveniently, the guide means comprises at least one, preferably two, wedge shaped guide members defining tapering surfaces which constitute at least part of the first and second surfaces. Preferably, each guide member is unitary.

Preferably the control means includes first sheet sensing means for sensing when a leading edge of a sheet in the first path is at a predetermined distance from the stacking station, the predetermined distance corresponding to the distance of a leading edge of the sheets in the second path upstream from the stacking station.

The sheet sensing means may be provided by any conventional arrangement such as phototransistor/-photodiode pairs positioned adjacent the respective paths.

Typically, sheets in the second path will be brought to the position upstream of the stacking station at which their leading edges are at the predetermined distance from the stacking station and further feeding will cease until a sheet is sensed in the first path at the predetermined distance whereupon the sheets in the first and second paths will be fed at the same speed to the stacking station.

Conveniently, the control means comprises a suitably programmed microcomputer.

Preferably, the apparatus further comprises second sensing means for detecting when a trailing edge of the assembled stack of sheets is at a predetermined position downstream of the stacking station. The second sensing means enables the control means to determine when a sheet or sheets in the first path have been assembled with the stack whereupon it may cause the assembled stack to be fed along the second path in the second direction past the stacking position. Conveniently the second sensing means senses passage of the trailing edge of the stack although if the length of a stack is known the second sensing means could be positioned to sense a leading edge of the stack corresponding to the trailing edge having left the stacking position. Similar positioning alternatives are available for the first sheet sensing means.

The invention is particularly useful with banknote feeding apparatus, for example banknote dispensers in which sheets are fed from a store and are assembled into a stack which is then dispensed to a user.

It should also be noted that sheet feeding apparatus may incorporate a plurality of apparatuses according to the invention whereby the second transport means of each apparatus feeds an assembled stack of sheets to the first transport means of a successive assembly apparatus. In this way, a stack of sheets from different stores can be assembled.

Conveniently, the transport means comprise cooperating pairs of drive belts driven by the same or respective motors. Other arrangements are possible. For example part of the second transport means could comprise a tray which is movable to an fro past the stacking station and which cooperates with drive belts upstream and downstream of the stacking station.

BRIEF DESCRIPTION OF THE DRAWINGS

In order that the invention may be better understood, an example of apparatus according to the invention for assembling sheets into a stack will now be described with reference to the accompanying drawings, in which.

DETAILED DESCRIPTION OF AN EMBODIMENT

Figure 1:
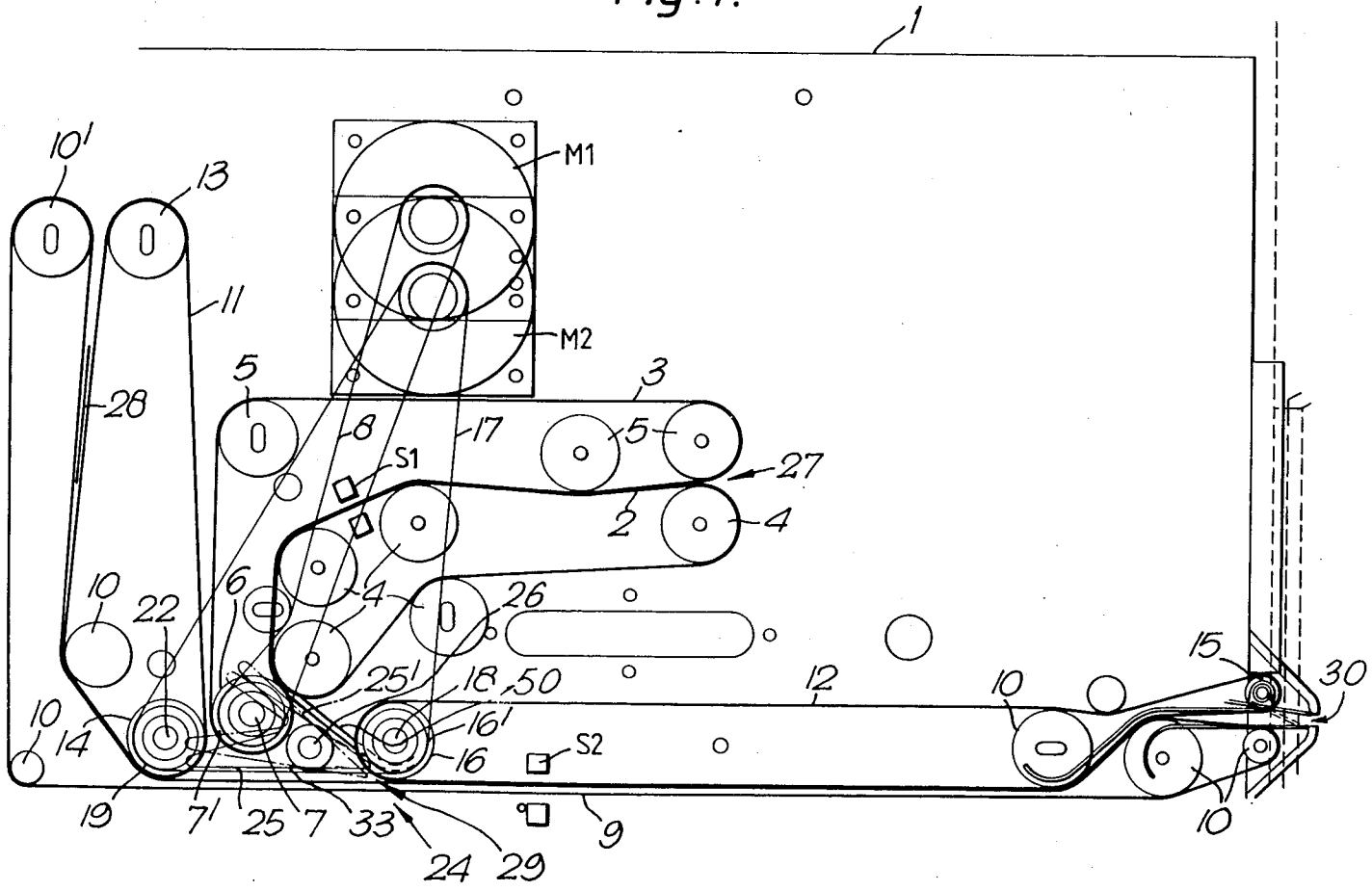
FIG. 1 is a schematic side view of the apparatus.

The apparatus illustrated in FIG. 1 will typically form part of a sheet feeding system such as a banknote feeding system (for example a banknote acceptor) which is not otherwise illustrated. The apparatus is supported between a pair of side plates 1, 1'. The apparatus comprises a first transport system defined by two laterally spaced pairs of cooperating belts 2, 3. Only one of each pair of belts is illustrated in FIG. 1. The belts 2 are entrained about idler rollers 4 while each belt 3 is entrained about idler rollers 5 and respective drive rollers 6. Each drive roller 6 is non-rotatably mounted to a drive shaft 7 which is driven via a drive pulley 7' non-rotatably mounted to the shaft 7 and connected by a drive belt 8 to a motor M1.

A second sheet transport system comprises a laterally spaced pair of drive belts 9 entrained about idler rollers 10, tensioning rollers 10' and drive rollers 14 mounted on a shaft 22. The belts 9 cooperate with a pair of belts 11, 12. Only one of each pair of belts is illustrated in FIG. 1. Each belt 11 is entrained about idler rollers 10,13 and a respective drive roller 14 and each belt 12 is entrained about idler rollers 10,15 and a respective drive roller 16. A motor M2 selectively drives, as will be explained below, a toothed drive belt 17 which is entrained around a drive pulley 16' mounted non-rotatably on a shaft 18 on which the drive rollers 16 are also non-rotatably mounted. The drive belt 17 also engages a drive pulley 19 mounted non-rotatably on the shaft 22 to which the drive rollers 14 are non-rotatably mounted. The motor M2 thus causes motion of the second transport system via the shafts 18, 22.

The motors M1, M2 are controlled by a microprocessor 31 (FIG. 4) (such as a 6809) in response to signals from a pair of sensors S1, S2. Each sensor S1, S2 comprises a light emitting diode (LED) and a phototransistor arranged on opposite sides of the first and second feed paths defined by the first and second transport systems respectively.

Figure 3:
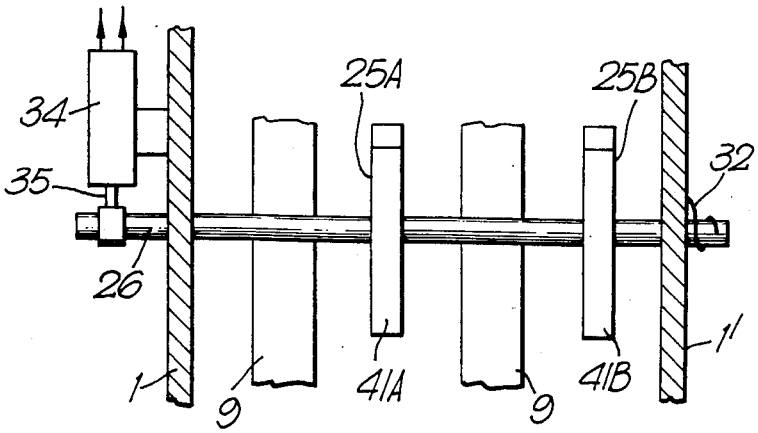
FIG. 3 is a plan, with the side plates shown in section, of the stacking station with other parts omitted for clarity; and, FIG. 4 illustrates apparatus for controlling the position of the diverter.

A stacking station 24 is positioned at the junction between the first transport system and the second transport system and includes a diverter 25 formed by a pair of generally wedge shaped, unitary elements 25A, 25B each being non-rotatably mounted to a shaft 26 pivoted between the side plates 1, 1'. The diverter 25 is biased into the position shown in solid lines in FIG. 1 by a spring 32 (FIG. 3) extending from the shaft 26 to the side plate 1'. In this position, lower surfaces of the elements 25A, 25B (including a surface 33 of element 25A) enable sheets to pass to and fro under the diverter 25 from upstream of the stacking station 24 between belts 9, 11 and downstream of the stacking station between belts 9,12.

Figure 4:
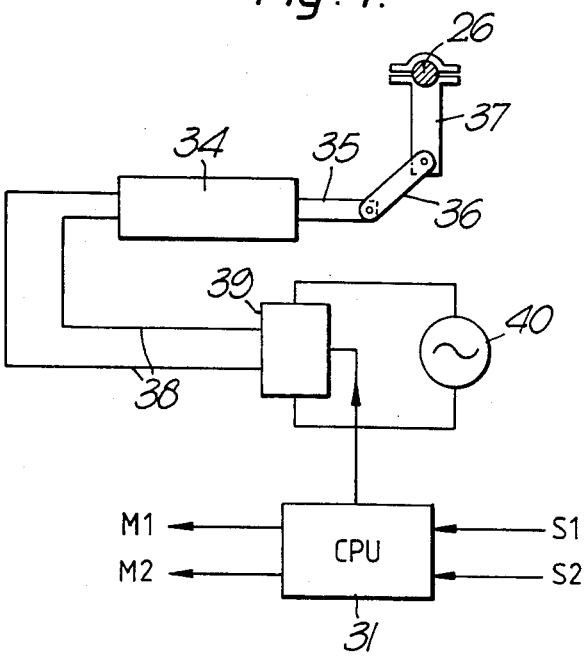

The diverter 25 is moveable under the control of a solenoid 34 mounted to the side plate 1 to a second position 25' shown in phantom in FIG. 1. A plunger 35 of the solenoid 34 is pivoted to a link 36 which in turn is connected to a radius arm 37 non-rotatably mounted to the shaft 26 as shown in FIG. 4. The solenoid 34 is connected by control wires 38 to a switch 39 controlled by the microcomputer 31. An AC supply 40 is connected to opposite terminals of the switch 39 and the switch 39 is operable to cause the solenoid 34 to be selectively energised. Energisation of the solenoid 34 will cause the plunger 35 to be drawn into the solenoid thus causing the shaft 26 to rotate in a clockwise direction, as seen in FIGS. 1 and 4, so that the diverter elements 25A, 25B will move to the position shown at 25' at FIG. 1. In this second position 25', sheets fed along the first path by the first transport system are guided along upper surfaces 41A, 41B of the elements 25A, 25B into the second transport system downstream of the stacking station 24.

A guide plate 50 extends from the nips between the drive rollers 6 and idler rollers 4 to the drive rollers 16.

In use, sheets are fed singly or in small stacks into nips 27 between corresponding pairs of idler rollers 4, 5. These sheets are carried between the belts 2, 3 under the control of the motor M1 into the stacking station 24. Previously assembled sheets are held stationary between the belts 9, 11 in a stack 28 at a known position relatively to a point 29 at the trailing end of the stacking station.

Figure 2:
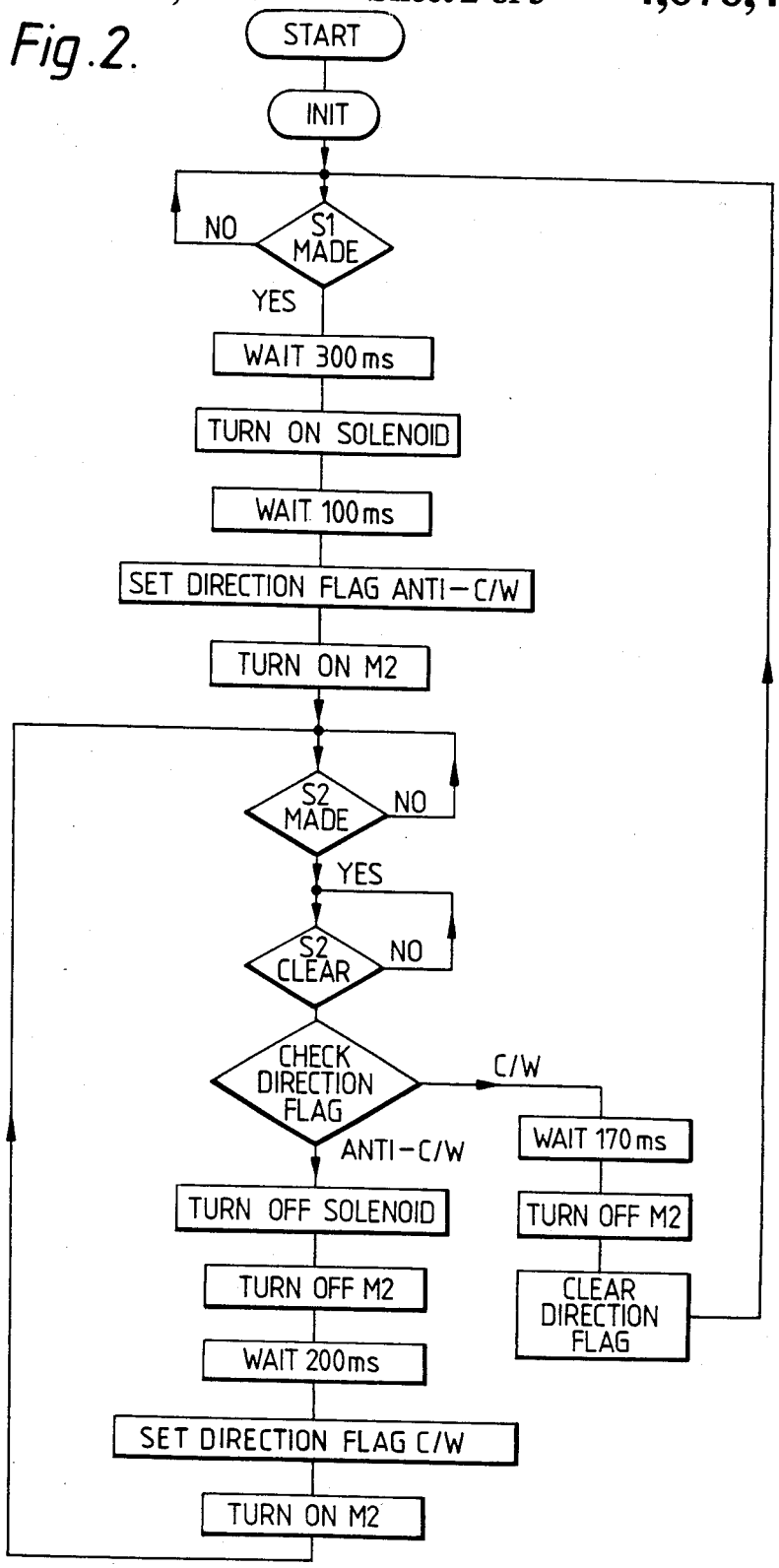
FIG. 2 is a flow diagram illustrating operation of a microcomputer.

FIG. 2 illustrates a flow diagram of a computer program for controlling the microprocessor and reference should be made to this flow diagram in the following description of the operation of the apparatus. In this description it will be assumed that US dollar bills (with lengths of 156 mm) are fed and the transport speeds are about 200 mm/sec.

The light beam from the LED in the sensor S1 is broken as soon as a leading edge of a sheet reaches the sensor. The microprocessor detects at this stage that the sensor S1 is made and initiates a predetermined time delay (for example 300 milliseconds). After this time delay the solenoid is actuated to move the diverter 25 to its second position 25'. After a further time delay (for example 100 milliseconds) a direction flag is set to "anti-clockwise" and the motor M2 actuated to cause the drive rollers 14, 16 to rotate in an anti-clockwise direction. This causes the stacked sheets 28 to be moved from an escrow position shown in FIG. 1 along the second path towards the stacking station 24. The motors M1, M2 are controlled so that the stack 28 moves at the same speed as the sheet or sheets in the first transport system and its movement is timed so that the sheets in the first transport system will be drawn onto the stack 28 as both stack (guided by lower surfaces of elements 25A, 25B) and sheet or sheets (guided between upper surfaces 41A, 41B and guide plate 50) pass into the portion of the second transport system defined by the belts 9, 12 downstream of the stacking station.

As soon as a leading end of the new stack passes the sensor S2, the microprocessor will detect that the sensor S2 is made. The microprocessor then waits until the sensor S2 is clear indicating that the trailing edge of the stack has passed the sensor and is thus clear of the stacking station 24. The microprocessor then examines the direction flag and since it is set "anti-clockwise" at this stage, the microprocessor turns off the solenoid thus allowing the diverter 25 to return to its first position under spring action. Simultaneously, the motor M2 is turned off and a time out (for example 200 milliseconds) is initiated to allow the diverter 25 to return to its first position.

At this stage, the direction flag is set in the opposite direction (i.e. "clockwise") and the motor M2 actuated so that the second transport system moves the newly assembled stack to the left as shown in FIG. 1. During this movement, the diverter elements 25A, 25B are positioned so that the stack is guided by their lower surfaces and is prevented from being fed into the first transport system.

This movement will cause the stack to pass the sensor S2 again so that the sensor S2 will first be made and then cleared. At this stage, the microprocessor again looks at the direction flag and at this stage it is indicating "clockwise" movement of the second transport system so that after a time delay of for example 170 milliseconds the motor M2 is turned off. This time delay is chosen to be of a length such that the assembled stack has returned to the escrow position with its leading edge at the known position relative to the point 29. The direction flag is then cleared and the process can then be repeated for a newly fed sheet or sheets.

Once all sheets have been fed through the nips 27, which may be determined for example if the sensor S1 does not detect the passage of a sheet after a suitable period, the microprocessor will control the motor M2 to pass the fully assembled stack in either direction to other parts of the feeding apparatus such as a cassette or, as shown, to a dispense outlet 30.

I claim:

1. Apparatus for assembling sheets into a stack, the apparatus comprising a stacking station having guide means defining first and second guide surfaces fixed relatively to one another; first and second transport systems defining respective first and second paths, said first transport system being adapted to transport sheets along said first path to said stacking station and said second transport system being adapted to transport sheets in both directions along said second path between positions upstream and downstream of said stacking station, wherein said guide means is movable between first and second postions whereby in said first position sheets fed along said first and second paths from positions upstream of said stacking station are guided along respective ones of said first and second guide surfaces past said guide means to a position downstream of said stacking station in said second path, and in said second position said guide means enables sheets in said second path to be moved between positions upstream and downstream of said stacking station along said second path guided by said second surface and prevents sheets from passing into said first path; and control means for controlling operation of said first and second transport systems and said position of said guide means whereby when said guide means is in said first position, the speeds of said first and second transport systems are controlled such that sheets fed along said first and second paths from upstream of said stacking station are assembled together in a stack in said second path downstream of said stacking station.

2. Apparatus according to claim 1, wherein said guide means is biased towards said second position and is movable to said first position under control of said control means.

3. Apparatus according to claim 1, wherein said control means includes a solenoid coupled with said guide means and operable to move said guide means at least to said first position.

4. Apparatus according to claim 1, wherein said guide means is non-rotatably mounted to a pivotally mounted shaft coupled with said control means, whereby rotation of said shaft causes said guide means to move between said first and second positions.

5. Apparatus according to claim 4, wherein said control means includes a solenoid coupled with said guide means and operable to move said guide means at least to said first position, and wherein said solenoid has a plunger coupled to a radially extending arm mounted to said shaft.

6. Apparatus according to claim 1, wherein said guide means comprises at least one wedge shaped guide member defining tapering surfaces which constitute at least part of said first and second surfaces.

7. Apparatus according to claim 6, wherein said at least one guide member is unitary.

8. Apparatus according to claim 1, wherein said control means includes first sheet sensing means for sensing when a leading edge of a sheet in said first path is at a predetermined distance from said stacking station, said predetermined distance corresponding to the distance of a leading edge of said sheets in said second path upstream from said stacking station.

9. Apparatus according to claim 8, further comprising second sensing means for detecting when a trailing edge of said assembled stack of sheets is at a predetermined position downstream of said stacking station.

10. Banknote feeding apparatus comprising a stacking station having guide means defining first and second guide surfaces fixed relatively to one another; first and second transport systems defining respective first and second paths, said first transport system being adapted to transport banknotes along said first path to said stacking station and said second transport system being adapted to transport banknotes in both directions along said second path between positions upstream and downstream of said stacking station, wherein said guide means is movable between first and second positions whereby in said first position banknotes fed along said first and second paths from positions upstream of said stacking station are guided along respective ones of said first and second guide surfaces past said guide means to a position downstream of said stacking station in said second path, and in said second position said guide means enables banknotes in said second path to be moved between positions upstream and downstream of said stacking station along said second path guided by said second surface and prevents banknotes from passing into said first path; control means for controlling operation of said first and second transport systems and said position of said guide means whereby when said guide means is in said first position, the speeds of said first and second transport systems are controlled such that banknotes fed along said first and second paths from upstream of said stacking station are assembled together in a stack in said second path downstream of said stacking station; an input station associated with said first transport system whereby banknotes are fed into said first transport system at said input station; and an output station downstream of said stacking station and adjacent said second path.

* * * * *